US006205430B1

(12) United States Patent
Hui

(10) Patent No.: US 6,205,430 B1
(45) Date of Patent: Mar. 20, 2001

(54) AUDIO DECODER WITH AN ADAPTIVE FREQUENCY DOMAIN DOWNMIXER

(75) Inventor: Yau Wai Lucas Hui, Singapore (SG)

(73) Assignee: STMicroelectronics Asia Pacific PTE Limited (SG)

( * ) Notice: Subject to any disclaimer, the term of this patent is extended or adjusted under 35 U.S.C. 154(b) by 0 days.

(21) Appl. No.: 09/297,112

(22) PCT Filed: Sep. 26, 1997

(86) PCT No.: PCT/SG97/00046

§ 371 Date: Jun. 21, 1999

§ 102(e) Date: Jun. 21, 1999

(87) PCT Pub. No.: WO98/18230

PCT Pub. Date: Apr. 30, 1998

(30) Foreign Application Priority Data

Oct. 24, 1996 (SG) ..... 9610940

(51) Int. Cl.[7] ..... G10L 21/00; G10L 19/00
(52) U.S. Cl. ..... 704/500; 704/503
(58) Field of Search ..... 704/500, 501, 704/502, 503, 504

(56) References Cited

U.S. PATENT DOCUMENTS 5,400,433 * 3/1995 Davis et al. ..... 704/220
5,867,819 * 2/1999 Fukuchi et al. ..... 704/500
5,946,352 * 8/1999 Rowlands et al. ..... 375/242

OTHER PUBLICATIONS

Vernon, Steve, "Design and Implementation of AC–3 Coders", *IEEE Transactions on Consumer Electronics*, vol. 41, No. 3, Aug. 1995, New York, US, pp. 754–759, XP000539533.

Bosi, M., and Forshay, S.E., "High Quality Audio Coding for HDTV: An Overview of AC–3", *Signal Processing of HDTV, VI; Proceedings of the International Workshop on HDTV '94*, Oct. 26–28, 1994, Turin, IT, pp. 231–238, XP002067767.

* cited by examiner

*Primary Examiner*—Richemond Dorvil
*Assistant Examiner*—Abul K. Azad
(74) *Attorney, Agent, or Firm*—Theodore E. Galanthay; David V. Carlson; Seed IP Law Group PLLC

(57) ABSTRACT

A method and apparatus for decoding a multi-channel audio bitstream in which adaptive frequency domain downmixer (3) is used to downmix, according to long and shorter transform block length information (17), the decoded frequency coefficients of the multi-channel audio (12,13,14,15) such that the long and shorter transform block information is maintained separately within the mixed down left and right channels. In this way, the long and shorter transform block coefficients of the mixed down let and right channels can be inverse transformed adaptively (4,5,6,7) according to the long and shorter transform block information, and the results of the inverse transform of the long and short block of each the left and right channel added together (8,9) to form the total mixed down output of the left and right channel.

6 Claims, 5 Drawing Sheets

AUDIO DECODER WITH AN ADAPTIVE FREQUENCY DOMAIN DOWNMIXER

FIELD OF THE INVENTION

This invention relates to multi-channel digital audio decoders for digital storage media and transmission media.

BACKGROUND ART

An efficient multi-channel digital audio signal coding method has been developed for storage or transmission applications such as the digital video disc (DVD) player and the high definition digital TV receiver (set-top-box). A description of the standard can be found in the ATSC Standard, "Digital Audio Compression (AC-3) Standard", Document A/52, Dec. 20, 1995. The standard defined a coding method for up to six channel of multi-channel audio, that is, the left, right, centre, surround left, surround right, and the low frequency effects (LFE) channel.

In this coding method, the multi-channel digital audio source is compressed block by block at the encoder by first transforming each input block audio PCM samples into frequency coefficients using an analysis filter bank, then quantizing the resulting frequency coefficients into quantized coefficients with a determined bit allocation strategy, and finally formatting and packing the quantized coefficients and bit allocation information into bit-stream for storage or transmission.

Depending upon the spectral and temporal characteristics of the audio source, adaptive transformation of the audio source is done at the encoder to optimize the frequency/time resolution. This is achieved by adaptive switching between two transformations with long transform block length or shorter transforms block length. The long transform block length which has good frequency resolution is used for improved coding performance; on the other hand, the shorter transform block length which has a greater time resolution is used for audio input signals which change rapidly in time.

At the decoder side, each audio block is decompressed from the bitstream by first determining the bit allocation information, then unpacking and de-quantizing the quantized co-efficients, and inverse transforming the resulting coefficients based on determined long or shorter transform length to output audio PCM data. The decoding processes are performed for each channel in the multi-channel audio data.

For reasons such as overall systems cost constrain or physical limitation in terms of number of output loudspeakers that can be used, downmixing of the decoded multi-channel audio is performed so that the number of output channels at the decoder is reduced to two channels, hence the left and right ($L_m$ and $R_m$ ) channels suitable for conventional stereo audio amplifier and loudspeakers systems.

Basically, downmixing is performed such that the multi-channel audio information is preserved while the number of output channels is reduced to only two channels. The method of downmixing may be described as:

$$L_m=a_0L+a_1R+a_2C+a_3L_5+a_4R_5+a_5LFE$$

$$R_m=b_0L+b_1R+b_2C+b_3L_5+b_4R_5+b_5LFE$$

where $L_m$: Mixed down Left channel output $R_m$: Mixed down Right channel output L: Left channel input R: Right channel input C: Centre channel input $L_3$:Surround left channel input $R_3$:Surround right channel input $a_{0-5}$: downmixing coefficients for left channel output $b_{0-5}$:downmixing coefficients for right channel output.

Downmixing method or coefficients may be designed such that the original or the approximate of the original decoded multichannel signals may be derived from the mixed down Left and Right channels.

For decoders in systems or applications where downmixing is required, the decoding processes which include the inverse transformation are required for all encoded channels before downmixing can be done to generate the two output channels. The implementation complexity and the computation load is not reduced for such present art decoders even though only two output channels are generated instead of all channels in the multi-channel bitstream.

To significantly reduce the implementation complexity and the computation load, the downmixing process should be performed at an early stage within the decoding processes such that the number of channels required to be decoded are reduced for the remaining decoding processes. In particular, since the inverse transform process is a complex and computationally intensive process, the downmixing should be performed on the inverse quantized frequency coefficients before the inverse transform. One example of such solution is given in U.S. Pat. No. 5,400,433 for which the inverse transform process was assumed to be linear. Another example is referred to in an article by Steve VERNON "Design and Implementation of AC-3 Coders", IEEE Transactions on Consumer Electronics, vol. 41, no. 3, August 1995, NEW YORK US, pages 754–759. Again, downmixing in the frequency domain is disclosed but only in the case where block switching is not used.

Due to the fact that inverse transform process of present art is adaptive in long or shorter transform block length depending upon the spectral and temporal characteristics of each coded audio channel, it is not a linear process and therefore the known downmixing process cannot be performed first. That is, combining the channels before the inverse transform process will not produce the same output that is produced by combining the channels after the inverse transform process.

DISCLOSURE OF THE INVENTION

It is an object of this invention to provide a method and apparatus for decoding a multi-channel audio bitstream which will overcome or at least ameliorate the foregoing disadvantages.

In the present invention, an adaptive frequency domain downmixer is used to downmix, according to the long and shorter transform block length information, the decoded frequency coefficients of the multi-channel audio such that the long and short transform block information is maintained separately within the mixed down left and right channels. In this way, the long and shorter transform block coefficients of the mixed down left and right channels can still be inverse transformed adaptively according to the long and shorter transform block information, and the results of the inverse transform of the long and short block of each of the left and right channel are added together to form the total mixed down output of the left and right channel.

Accordingly, in a first aspect, this invention provides a method of decoding a multi-channel audio bitstream comprising the steps of subjecting said multi-channel audio bitstream to a block decoding process to obtain frequency coefficients for each audio channel within each block in the said multi-channel audio bitstream, unpacking long and shorter transform bock information for each audio channel within said block from said multi-channel audio bitstream, and determining downmixing coefficients for each audio channel within said multi-channel audio bitstream, the method including the steps of:

(a) downmixing and frequency coefficients of each audio channel within said block which are identified as long transform block by said long and shorter transform block information to form a left mixed down for long transform block and a right mixed down for long transform block;

(b) downmixing said frequency coefficients of each audio channels within the said block which are identified as shorter transform block by said long and shorter transform block information to form a left mixed down for shorter transform block and a right mixed down for shorter transform block;

(c) inverse transforming each of said left mixed down for long transform block, said right mixed down for long transform block, said left mixed down for shorter transform block, and said right mixed down for shorter transform block to produce a left mixed down long inverse transformed block, a right mixed down long inverse transformed block, a left mixed down shorter inverse transformed block, and a right mixed down shorter inverse transformed block respectively;

(d) adding said left mixed down long inverse transformed block and said left mixed down shorter inverse transformed block to form a left total mixed down; and (e) adding said right mixed down long inverse transformed block and said right mixed down shorter inverse transformed block to form a right total mixed down.

In a second aspect, this invention provides an apparatus for decoding a multi-channel audio bitstream comprising means for block decoding said multi-channel audio bitstream to obtain frequency coefficients of each audio channel with each block, means for unpacking long and shorter transform block information for each audio channel within said block, and means for determining downmixing coefficients for each audio channel within said multi-channel audio bitstream, the apparatus including:

(a) means for downmixing said frequency coefficients of each audio channel identified as long transform block by said long and shorter transform block information to form a left mixed down for long transform block and a right mixed down for long transform block;

(b) means for downmixing said frequency coefficients of each audio channel identified as shorter transform block by said long and shorter transform block information to form a left mixed down for shorter transform block and a right mixed down for shorter transform block;

(c) means for inverse transforming each of said left mixed down for long transform block, said right mixed down for long transform block, said left mixed down for shorter transform block, and said right mixed down for shorter transform block to produce a left mixed down long inverse transformed block, a right mixed down long inverse transformed block, a left mixed down shorter inverse transformed block, and a right mixed down shorter inverse transformed block respectively;

(d) means for adding said left mixed down long inverse transformed block and said left mixed down shorter inverse transformed block to form a left total mixed down;

(e) means for adding of said right mixed down long inverse transformed block and said right mixed down shorter inverse transformed block to form a right total mixed down.

Preferably, the block decoding process includes:

(a) parsing the said multi-channel audio bitstream to obtain bit allocation information on each audio channel within said block;

(b) unpacking quantized frequency coefficients from said block using said bit allocation information; and (c) de-quantizing said quantized frequency coefficients to obtain said frequency coefficients using said bit allocation information.

A post-processing step is also preferably performed in which:

(a) the left total mixed down is subjected to a window overlap/add process wherein the samples within the left total mixed down are weighted, de-interleaved, overlapped and added to samples of a previous block;

(b) the right total mixed down is subjected to a window overlap/add process wherein the samples within right total mixed down are weighted, de-interleaved, overlapped and added to samples of a previous block; and (c) the results of the window overlap/add are subjected to an output process wherein the results of the window overlap/add process are formatted and outputted.

According to a preferred embodiment of the present invention, an input coded bitstream of multi-channel audio is first parsed and the bit allocation information for each audio channel block is decoded. With the bit allocation information, the quantized frequency coefficients of each audio channel block are unpacked from the bitstream and de-quantized. The de-quantized frequency coefficients of all audio channels of a block are then mixed down. This downmixing (c) the results of the window overlap/add are subjected to an output process wherein the results of the window overlap/add process are formatted and outputted.

According to a preferred embodiment of the present invention, an input coded bitstream of multichannel audio is first parsed and the bit allocation information for each audio channel block is decoded. With the bit allocation information, the quantized frequency coefficients of each audio channel block are unpacked from the bitstream and de-quantized. The de-quantized frequency coefficients of all audio channels of a block are then mixed down. This downmixing is done separately for audio channel blocks that are of long transform block length and of shorter transform block length; hence, four blocks of mixed down transform coefficients are formed: the left mixed down for long transform block, the left mixed down for shorter transform block, the right mixed down for long transform block, and the right mixed down for shorter transform block.

The four blocks of mixed down transform coefficients are subjected to the respective inverse transform for long transform block and shorter transform block. At the end of the inverse transform, the non-linearity between the long and shorter transform blocks is removed. The results of inverse transform of the left mixed down for longer transform block and left mixed down for shorter transform block are added together to form the total mixed down left channel signal. Similarly, the total mixed down right channel signal is formed. Any further post-processing required can then be performed on only these two total mixed down channels, and the final results are outputted as audio PCM samples for the left and right channels.

BRIEF DESCRIPTION OF THE DRAWINGS

The invention will now be described by way of example only, with reference to the accompany drawings in which.

BEST MODES FOR CARRYING OUT THE INVENTION

Figure 1:
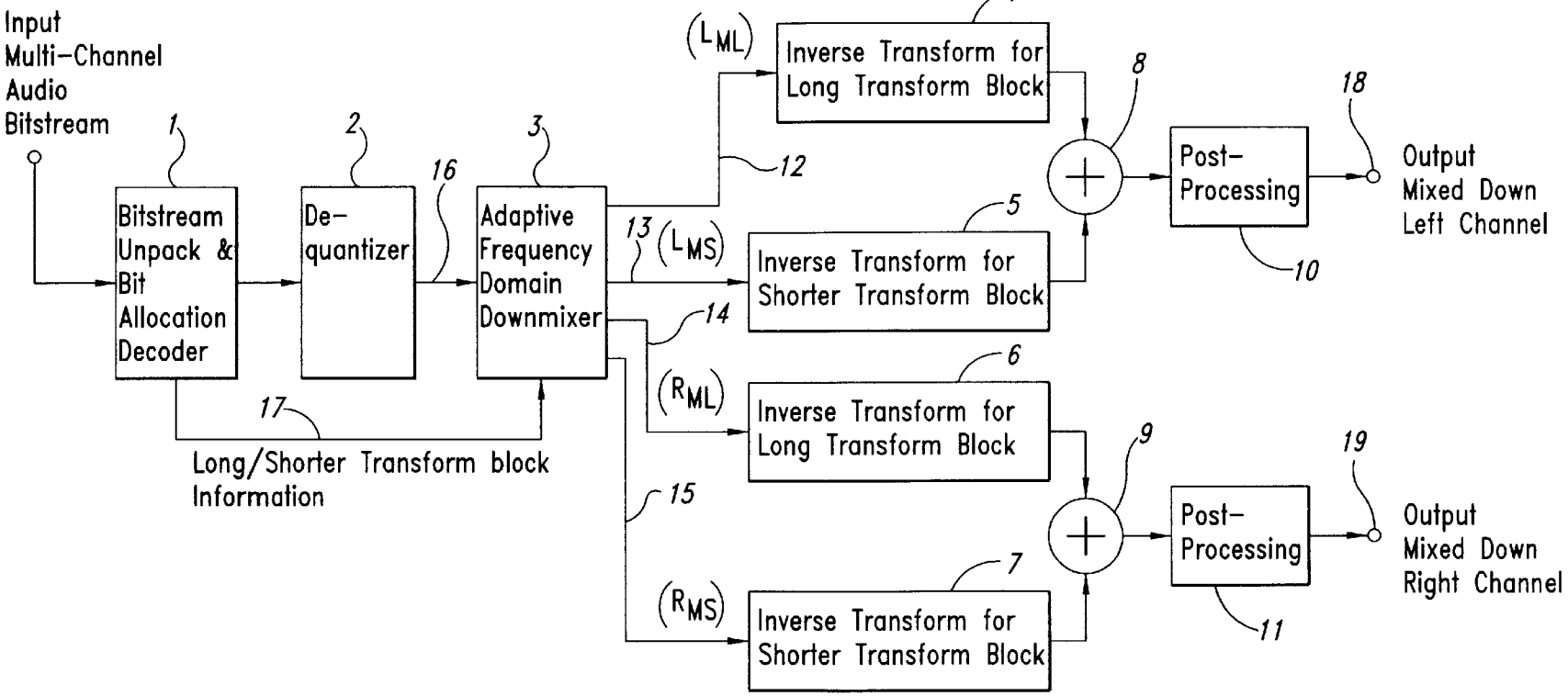
FIG. 1 is a block diagram of the audio decoder according to one embodiment of the present invention.

An audio decoder with an adaptive frequency domain downmixer according to a preferred embodiment of the present invention is shown in FIG. 1. An input multi-channel audio bitstream is first decoded by a bitstream unpack and bit allocation decoder 1. An example of the input multi-channel audio bitstream is the compressed bitstream according to the ATSC Standard, "Digital Audio Compression (AC-3) Standard", Document A/52, Dec. 20, 1995. This input AC-3 bitstream consists of coded information of up to six channels of audio signal including the left channel (L), the right channel (R), the center channel (C), the left surround channel ($L_5$), the right surround channel ($R_5$), and the low frequency effects channel (LFE). However, the maximum number of coded audio channels for the input is not limited. The coded information within the AC-3 bitstream is divided into frames of 6 audio blocks, and each of the 6 audio block contains the information for all of the coded audio channel block (ie. L,R,C,$L_5$, $R_5$ and LFE).

In the bitstream unpack and bit allocation decoder 1, the input multi-channel audio bitstream is parsed and decoded to obtain the bit allocation information for each coded audio channel block. With the bit allocation information, the quantized frequency coefficients of each coded audio channel block are decoded from the input multi-channel audio bitstream. An example embodiment of the bitstream unpack and bit allocation decoder 1 may be found in the ATSC (AC-3) standard. The decoded quantized frequency coefficients of each coded audio channel block are inverse quantized by the de-quantizer 2 to produce the frequency coefficients 16 of corresponding coded audio channel block. Details of the de-quantizer 2 for AC-3 bitstream is found in the ATSC (AC-3) standard specification.

After generating the frequency coefficients of each or all of the audio channel block, the frequency coefficients are mixed down in the adaptive frequency domain downmixer 3 based on the long/shorter transform block information 17 extracted from the input bitstream to produce four blocks of mixed down frequency coefficients consisting the left mixed down for long transform block 12 ($L_{ML}$), the left mixed down for shorter transform block 13 ($L_{MS}$), the right mixed down for long transform block 14 ($R_{ML}$), and the right mixed down for shorter transform block 15 ($R_{MS}$). The $L_{ML}$ 12 and $L_{MS}$ 13 are subjected to inverse transform for long transform block 4 and inverse transform for shorter transform block 5 respectively, and the results are added together by the adder 8. Similarly, the $R_{ML}$ 14 and $R_{MS}$ 15 are subjected to inverse transform for long transform block 6 and inverse transform for shorter transform block 7 respectively, and the results are added together by the adder 9. The results of adder 8 and adder 9 are subjected to post-processing 10 and post-processing 11 respectively, subsequently and finally outputted as output mixed down left channel 18 and output mixed down right channel 19.

Figure 2A:
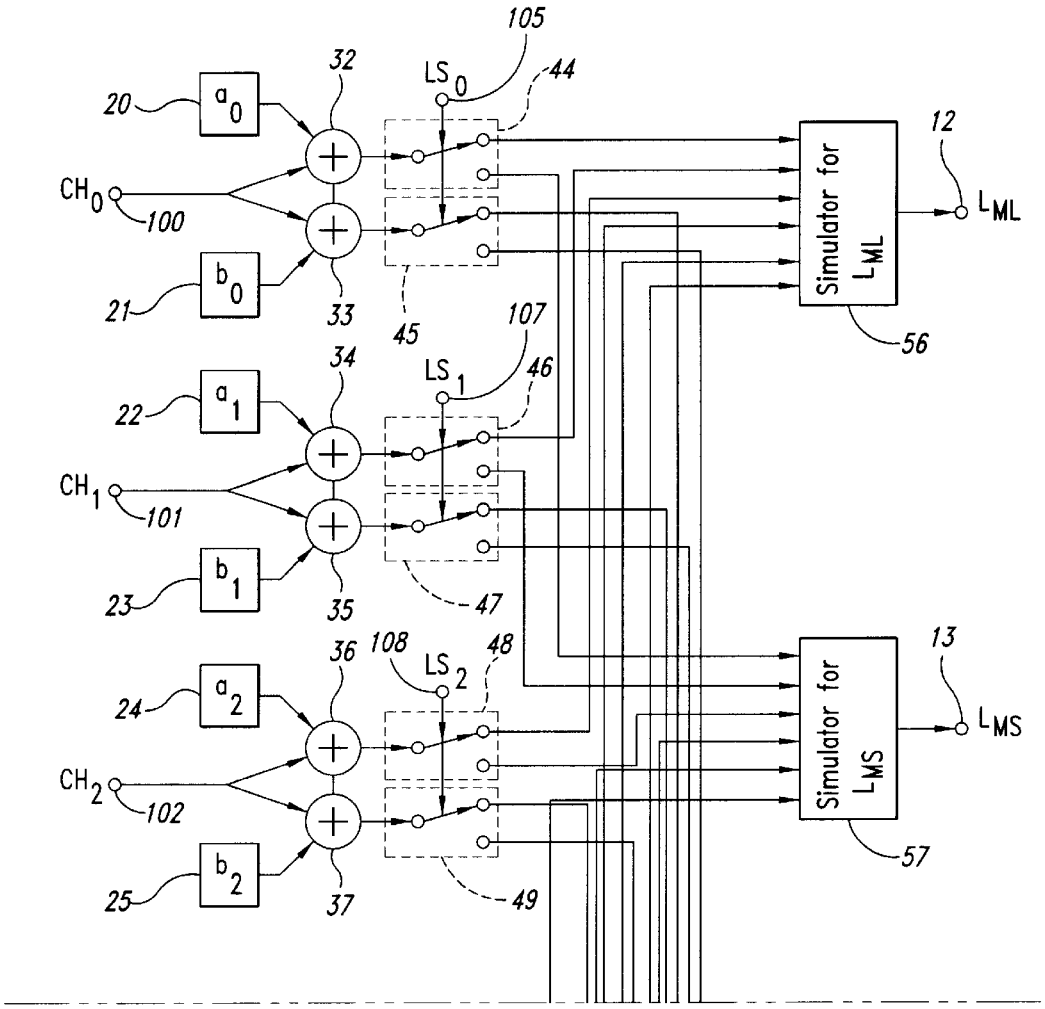
FIG. 2 is a block diagram of one embodiment of an adaptive frequency domain downmixer forming part of the decoder shown in FIG. 1.
Figure 2B:
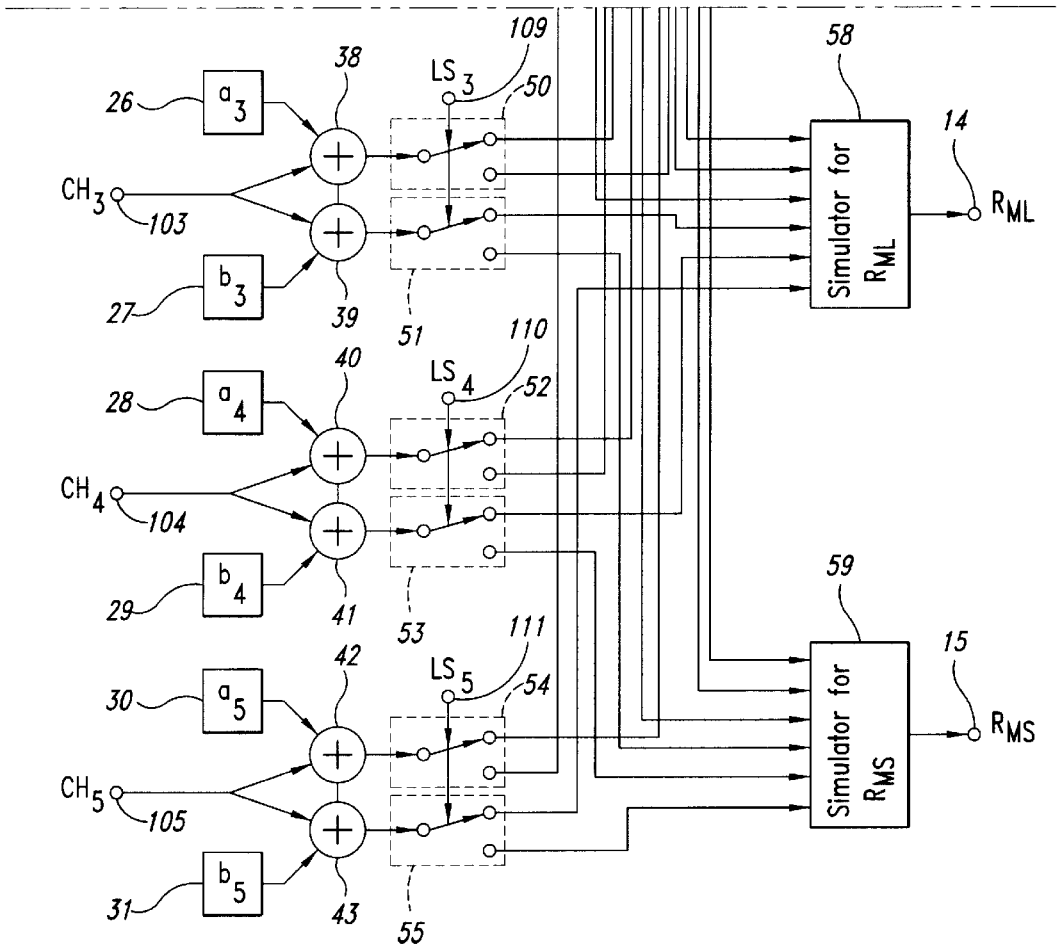

An embodiment of the adaptive frequency domain downmixer 3 is shown in FIG. 2. In this embodiment, the frequency coefficients (number 16 in FIG. 1) of an audio block are supplied in demultiplexed from $CH_0$ to $CH_5$ (numeral 100 to 105) with respect to six audio channel. The long and shorter transform block information (number 17 in FIG. 1) is also supplied in demultiplexed form $LS_0$ to $LS_5$ (numeral 106 to 111) with respect to the six audio channel. The input frequency coefficients $CH_0$ to $CH_5$ are first multiplied by the respective downmixing coefficients $a_0$ to $a_5$ and $b_0$ to $b_5$ (numeral 20 to 31) with multipliers (numeral 32 to 43). The downmixing coefficients are either determined by application or by information from the input bitstream. The switches (numeral 44 to 55) are used to switch according to the long and shorter transform block information $LS_0$ $LS_5$ of each of the audio channel the results of the multiplier (number 32 to 43) to the corresponding summator for $L_{ML}$ 56, summator for $L_{MS}$ 57, summator for $R_{ML}$ 58, and summator $R_{MS}$ 59. The results of the summator for $L_{ML}$ 56 summator for $L_{MS}$ 57, summator for $R_{ML}$ 58, and summator $R_{MS}$ 59 are outputted as $L_{ML}$ 12, $L_{MS}$ 13, $R_{ML}$ 14, $R_{MS}$ 15, respectively. The overall operations of this embodiment can be described in the following equations:

$$L_{ML} = \sum_{i=0}^{n} (a_i \times CH_i \times LS_i)$$

$$L_{MS} = \sum_{i=0}^{n} (a_i \times CH_i \overline{LS_i})$$

$$R_{ML} = \sum_{i=0}^{n} (b_i \times CH_i \times LS_i)$$

$$R_{MS} = \sum_{i=0}^{n} (b_i \times CH_i \times \overline{LS_i})$$

where $LS_i$ is the "Boolean" (0=shorter, 1=long) representation of the long and shorter transform for each of the channel i=0 to n.

It should be noted that the number of audio channels in the present embodiment is not limited to six, and can be expanded by increasing the number of multipliers and switches for the additional channels.

Figure 3:
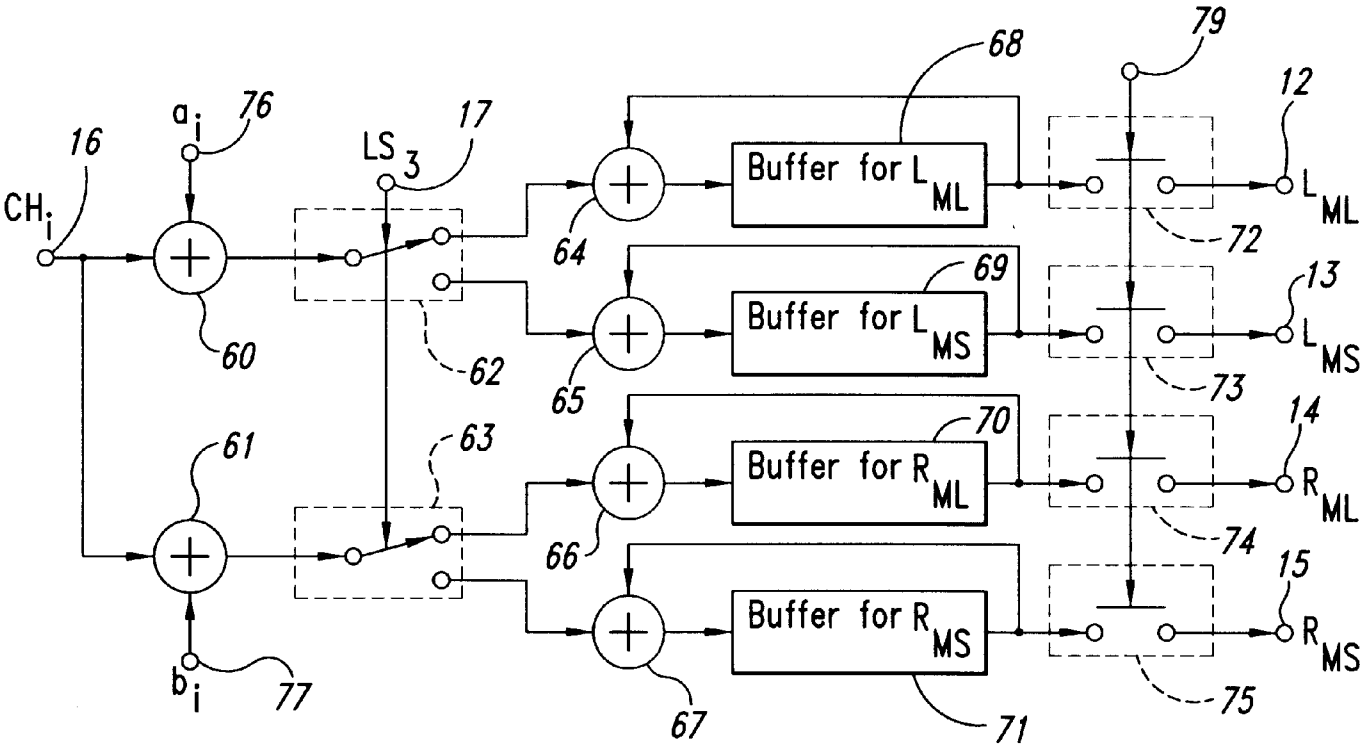
FIG. 3 is a block diagram another embodiment of the adaptive frequency domain downmixer shown in FIG. 2.

Another embodiment of the adaptive frequency domain downmixer 3 is shown in FIG. 3. The input frequency coefficients 16 are provided in sequence of the coded audio channel block as $CH_i$ where i is the audio current channel number. The input $CH_i$ is multiplied by the corresponding downmixing coefficients $a_i$ 76 and $b_i$ 77 using multiplier 60 and 61 respectively, and the results are switched according to the long and shorter transform block information $LS_i$ 17 of the current audio channel block. If the current audio channel block is a long transform block, the results of the multiplier 60 and 61 are accumulated to buffer for $L_{ML}$ 68 and buffer for $R_{ML}$ 70 respectively using the adder 64 and 66. On the other hand, if the current audio channel block is a shorter transform block, the results of the multiplier 60 and 61 are accumulated to buffer for $L_{MS}$ 69 and buffer for $R_{MS}$ 71 respectively using the adder 65 and 67. After all the frequency coefficients of an audio block are received and processed, the results in buffers for $L_{ML}$, $L_{MS}$, $R_{ML}$, and $R_{MS}$ are outputted with control $Output_M$ 79 as $L_{ML}$ 12, $L_{MS}$ 13, $R_{ML}$ 14, and $R_{MS}$ 15 respectively using switches 72, 73, 74 and 75.

Figure 4:
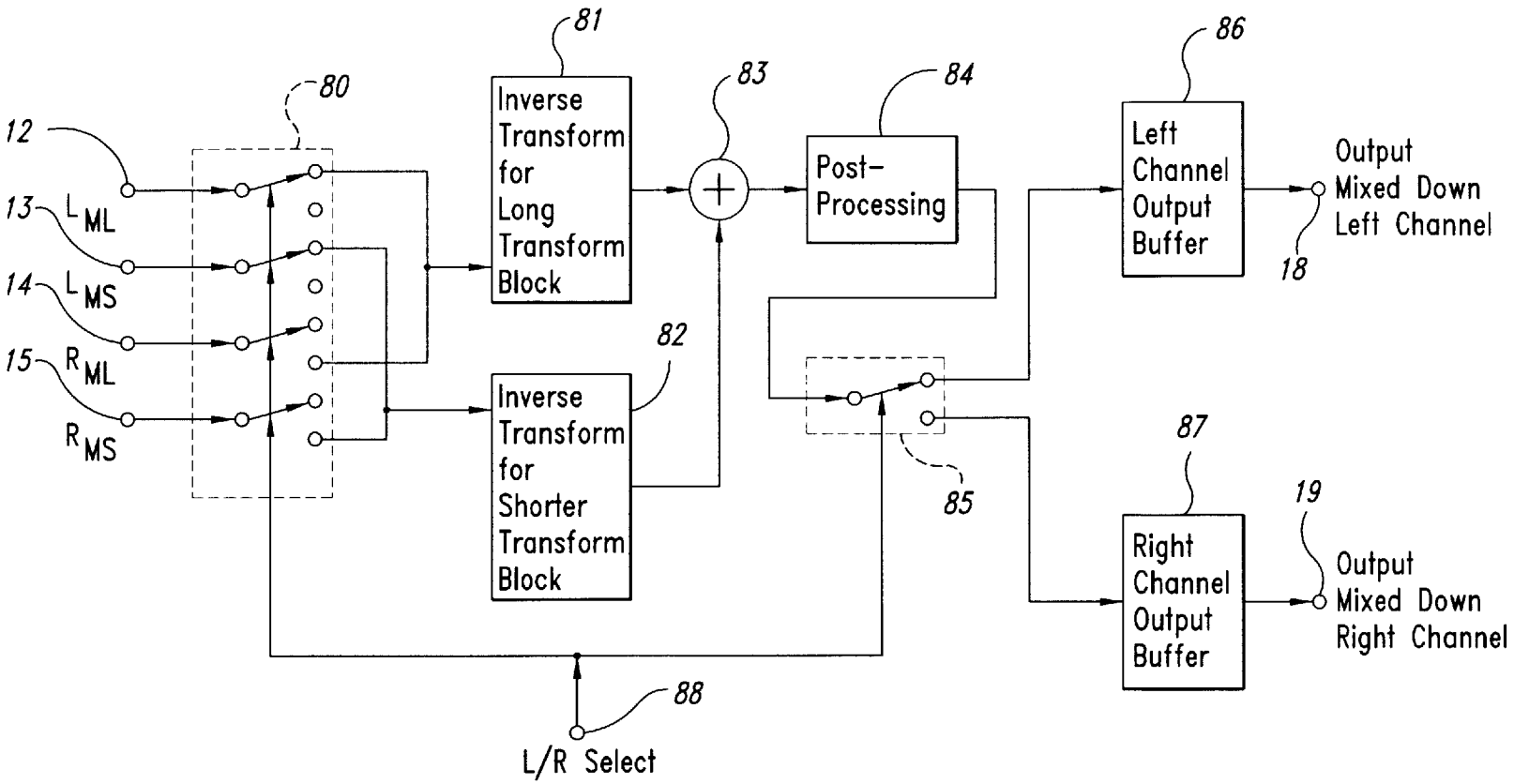
FIG. 4 is a block diagram of an alternate embodiment of the inverse transform and post-processing processes forming part of the present invention.

FIG. 4 shows an alternate embodiment of the inverse transform and post-processing processes. With the L/R select signal 88, switches 80 and 85, the input mixed down frequency coefficients $L_{ML}$ 12 and $L_{MS}$ 13 of an audio block are first inverse transformed with the respective inverse transform for long transform block 81 and inverse transform for shorter transform block 82. The results of the two inverse transform are added together by adder 83 and the subject to post-processing 84 before outputting to the left channel output buffer 86. Subsequently, the L/R select signal 88 is changed, and the input mixed down frequency coefficients $R_{ML}$ 14 and $R_{MS}$ 15 are inverse transformed with the respective inverse transform for long transform block 81 and inverse transform for shorter transform block 82. The results of the two inverse transform are added together by adder 83 and then subject to post-processing 84 before outputting to the right channel output buffer 87. Finally, the decompressed audio signals, output mixed down left channel 18 and output mixed down right channel 19, are sent out from the left channel output buffer 86 and right channel output buffer 87 respectively.

Examples of the inverse transform for long transform block (numerals 4 and 6 of FIG. 1 and numeral 81 of FIG. 4) and inverse transform for shorter transform block numeral 5 and 7 of FIG. 1 and numeral 82 of FIG. 4) can be found in the ATSC (AC-3) standard specification. An example embodiment of the post-processing module (numeral 10 and 11 of FIG. 1 and numeral 84 of FIG. 4) consist of window, overlap/add, scaling and quantization can also be found the ATSC (AC-3) standard specification.

It will be apparent that by maintaining the long and shorter transform block coefficients separately, downmixing can be performed in the frequency domain in a multi-channel audio decoder with adaptive long and shorter transform block coded input bitstream. As this adaptive downmixing is performed before the inverse transform, the number of inverse transform per audio block is reduced to four instead of the number of coded audio channels; hence, if the number of coded audio channels in the input bitstream to the multi-channel audio decoder is six to eight channels, the reduction of the number of inverse transform required will be two to four. This represents a signification reduction in implementation complexity and computation load requirement.

The foregoing describes only some embodiment of the invention and modifications can be made without departing from the scope of the invention.

The claims defining the invention are as follows:

1. A method of decoding a multi-channel audio bitstream comprising the steps of subjecting said multi-channel audio bitstream to a block decoding process to obtain frequency coefficients for each audio channel within each block in the said multi-channel audio bitstream, unpacking long and shorter transform block information for each audio channel within said block from said multi-channel audio bitstream, and determining downmixing coefficients for each audio channel within said multi-channel audio bitstream, the method including the steps of:

(a) downmixing said frequency coefficients of each audio channel within said block which are identified as long transform block by said long and shorter transform block information to form a left mixed down for long transform block and a right mixed down for long transform block;

(b) downmixing said frequency coefficients of each audio channels within the said block which are identified as shorter transform block by said long and shorter transform block information to form a left mixed down for shorter transform block and a right mixed down for shorter transform block;

(c) inverse transforming each of said left mixed down for long transform block, said right mixed down for long transform block, said left mixed down for shorter transform block, and said right mixed down for shorter transform block to produce a left mixed down long inverse transformed block, a right mixed down long inverse transformed block, a left mixed down shorter inverse transformed block, and a right mixed down shorter inverse transformed block respectively;

(d) adding said left mixed down long inverse transformed block and said left mixed down shorter inverse transformed block to form a left total mixed down; and (e) adding said right mixed down long inverse transformed block and said right mixed down shorter inverse transformed block to form a right total mixed down.

2. A method according to claim 1, wherein said block decoding process comprises the steps of:

(a) parsing the said multi-channel audio bitstream to obtain bit allocation information on each audio channel within said block;

(b) unpacking quantized frequency coefficients from said block using said bit allocation information; and (c) de-quantizing said quantized frequency coefficients to obtain said frequency coefficients using said bit allocation information.

3. A method according to claim 2, further including a post-processing step comprising:

(a) subjecting said left total mixed down to a window overlap/add process wherein the samples within said left total mixed down are weighted, de-interleaved, overlapped and added to samples of a previous block;

(b) subjecting said right total mixed down to a window overlap/add process wherein the samples within said right total mixed down are weighted, de-interleaved, overlapped and added to samples of a previous block; and (c) subjecting the results of the window overlap/add to an output process wherein said results of the window overlay/add process are formatted and outputted.

4. An apparatus for decoding a multi-channel audio bitstream comprising means for block decoding said multi-channel audio bitstream to obtain frequency coefficients of each audio channel with each block, means for unpacking long and shorter transform block information for each audio channel within said block, and means for determining downmixing coefficients for each audio channel within said multi-channel audio bitstream, the apparatus including:

(a) means for downmixing said frequency coefficients of each audio channel identified as long transform block by said long and shorter transform block information to form a left mixed down for long transform block and a right mixed down for long transform block;

(b) means for downmixing said frequency coefficients of each audio channel identified as shorter transform block by said long and shorter transform block information to form a left mixed down for shorter transform block and a right mixed down for shorter transform block;

(c) means for inverse transforming each of said left mixed down for long transform block, said right mixed down for long transform block, said left mixed down for shorter transform block, and said right mixed down for shorter transform block to produce a left mixed down long inverse transformed block, a right mixed down long inverse transformed block, a left mixed down shorter inverse transformed block, and a right mixed down shorter inverse transformed block respectively;

(d) means for adding said left mixed down long inverse transformed block and said left mixed down shorter inverse transformed block to form a left total mixed down;

(e) means for adding of said right mixed down long inverse transformed block and said right mixed down shorter inverse transformed block to form a right total mixed down.

5. An apparatus according to claim 4, wherein said means for block decoding comprises:

(a) means for parsing said multi-channel audio bitstream to obtain bit allocating information on each audio channel within said block;

(b) means for unpacking quantized frequency coefficients from said block using said bit allocation information; and (c) means for de-quantizing said quantized frequency coefficients to said frequency coefficients using said cit allocation information.

6. An apparatus according to claim 5, further including means for performing a post-processing process comprising:

(a) means for subjecting said left total mixed down to a window overlap/add process wherein the samples within said left total mixed down are weighted, de-interleaved, overlapped and added to samples of a previous block;

(b) means for subjecting said right total mixed down to a window overlap/add process wherein the samples within said right total mixed down are weighted, de-interleaved, overlapped and added to samples of a previous block; and (c) means for subjecting the results of said window overlap/add process to an output process where said results of the window overlap/add process are formatted and outputted.

* * * * *

UNITED STATES PATENT AND TRADEMARK OFFICE

CERTIFICATE OF CORRECTION

PATENT NO. : 6,205,430 B1
DATED : March 20, 2001
INVENTOR(S) : Yau Wai Lucas Hui It is certified that error appears in the above-identified patent and that said Letters Patent is hereby corrected as shown below:

Claim 3, column 8,
Line 52, "overlay/add process" should read -- overlap/add process --.

Claim 5, column 10,
Lines 5 and 6, "said cit allocation" should read -- said bit allocation --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*